US010370147B2

(12) United States Patent
Dimer

(10) Patent No.: US 10,370,147 B2
(45) Date of Patent: Aug. 6, 2019

(54) TRANSPORT AND STORAGE CONTAINER

(71) Applicant: montara Verpacken mit System GmbH, Grossschirma (DE)

(72) Inventor: Christoph Dimer, Teltow (DE)

(73) Assignee: Montara Verpaceken Mit System GmbH, Grossschirma (DE)

( * ) Notice: Subject to any disclaimer, the term of this patent is extended or adjusted under 35 U.S.C. 154(b) by 727 days.

(21) Appl. No.: 14/938,215

(22) Filed: Nov. 11, 2015

(65) Prior Publication Data

US 2017/0073106 A1 Mar. 16, 2017

(30) Foreign Application Priority Data

Sep. 16, 2015 (DE) ..... 10 2015 115 592

(51) Int. Cl.

| | |
|---|---|
| ***B65D 21/02*** | (2006.01) |
| ***B65D 6/18*** | (2006.01) |
| ***B65D 5/00*** | (2006.01) |
| ***B65D 5/28*** | (2006.01) |
| ***B65D 5/468*** | (2006.01) |
| ***B65D 5/42*** | (2006.01) |

(52) U.S. Cl.

CPC ..... *B65D 21/0215* (2013.01); *B65D 5/005* (2013.01); *B65D 5/28* (2013.01); *B65D 5/4283* (2013.01); *B65D 5/4608* (2013.01); *B65D 11/1833* (2013.01)

(58) Field of Classification Search

CPC ..... B65D 21/0215; B65D 5/005; B65D 5/28; B65D 5/4283; B65D 5/4608; B65D 11/1833; B65D 5/006

USPC ..... 220/642, 668, 639; 206/504, 512; 493/136, 88, 89, 909; 229/198, 198.1, 229/199, 918, 919, 117.16, 190, 193, 186, 229/187, 189

See application file for complete search history.

(56) References Cited

U.S. PATENT DOCUMENTS

| | | | |
|---|---|---|---|
| 2,544,283 | A | 3/1951 | Snyder |
| 2,941,710 | A | 6/1960 | Smith et al. |
| 4,172,623 | A | 10/1979 | Anderson |

(Continued)

FOREIGN PATENT DOCUMENTS

| | | |
|---|---|---|
| DE | 295 17 978 | 2/1996 |
| DE | 100 48 825 A1 | 4/2002 |

(Continued)

*Primary Examiner* — Fenn C Mathew
*Assistant Examiner* — Elizabeth J Volz
(74) *Attorney, Agent, or Firm* — Norris McLaughlin, P.A.

(57) ABSTRACT

A storage and transport container, in an unassembled state, is composed of a single-piece container blank having a bottom, foldable side and end walls and four corner flaps foldable inwardly at the side walls or the end walls. Respective turnover rims are integrally formed on the side walls and the end walls so that when the turnover rims are folded over, a stacking profile having a hook rim can be attached over the same. Four corner pieces are provided, wherein each corner piece has a base body having an upper stacking rim. Two insertion profiles are integrally formed on the base body, each having an angled profile section at the front end. The angled profile section positively fits in a respective profile recess of the side walls and the end walls. The stacking profiles extend over the insertion profiles flush against the stacking rim.

11 Claims, 7 Drawing Sheets

(56) References Cited

U.S. PATENT DOCUMENTS

| | | | | |
|---|---|---|---|---|
| 5,037,027 | A * | 7/1991 | Nichols | B65D 5/0055 229/198.1 |
| 5,295,632 | A * | 3/1994 | Zink et al. | B65D 5/0055 229/198 |
| 6,460,724 | B1 | 10/2002 | Bradford | |
| 2002/0079359 | A1* | 6/2002 | Bradford et al. | B65D 5/20 229/199 |

FOREIGN PATENT DOCUMENTS

| | | |
|---|---|---|
| EP | 0 674 595 | 11/1998 |
| EP | 1 505 001 | 2/2005 |
| NL | 6612391 | 3/1968 |

* cited by examiner 20
13
14
14

16
25
29
14

25
18
13

25
20
29

13
25
16
14

TRANSPORT AND STORAGE CONTAINER

BACKGROUND OF THE INVENTION

The invention relates to a stackable transport and storage container.

Transport and storage containers of this type are used in particular wherever tools or components are to be transported or temporarily stored as part of a manufacturing process. They are typically composed of metal sheets or plastic sheets, which are glued, welded or positively joined to each other. In addition to sufficient load-bearing capacity and a sufficient service life, it is also important that the containers preferably do not have any protrusions or projections that constrict the interior space or are an impediment otherwise.

While containers made of metal are relatively stable, they are often quite heavy and susceptible to corrosion, and use of the same creates excessive noise. Containers made of plastic materials have the advantage that they have a relatively low weight. On the other hand, they often have only low stability, which is compensated for by added reinforcements.

For comparable usages, injection-molded containers and containers produced from PR (polypropylene) twin-wall sheets of various designs are known. The injection-molded containers are containers produced in complex molds. Due to the high tooling costs, these can only be produced effectively in large quantities.

Comparable PR twin-wall containers are either characterized by being joined from a large number of individual parts, necessitating multiple individual work steps, or by simple folding and bending constructions, which are held so as to maintain the shape thereof by way of a peripheral stacking profile. For this purpose, thermal bending, ultrasonic welding techniques, bonding techniques, and other joining and processing operations are employed. In principle, the containers are characterized in that it is possible to also produce smaller quantities having a wide variety of dimensions, due to the lower tooling costs.

EP 1 505 001 A1 describes a stackable tote box made of thermoplastic resin for storing small parts of all types or for single-use or multi-use transport of the same. The tote box is always produced from thermoplastic resin. It comprises a bottom and usually four side walls, which are produced from a planar starting plate. This starting plate is preferably a twin-wall sheet.

Linear notches are introduced between the bottom and the side walls, about which the side walls can be folded to form a box-shaped base body. The abutting vertical edges of the side walls are welded together. A turnover rim adjoins at the upper edges of the side walls, which is folded 180° about linear notches in the starting plate against the respective side wall. A stacking profile is positively clipped over the turnover rim so that a protrusion integrally formed on the stacking profile secures the stacking profile on the turning rim.

A respective stacking corner can be attached at the corners, which includes a connecting piece shaped similarly to the turnover rim and extends the shape of the same. The stacking profile is positively clipped between the stacking corners over the turnover rim and over the connecting piece so that a protrusion integrally formed on the stacking profile secures the stacking profile on the turnover rim and the connecting piece. The stacking corner and the stacking profile usually have the same peripheral shape.

Due to being cut to size from a "Swiss cross", separate scrap pieces result at the corners, which are reusable by being inserted as corner brackets for lateral reinforcement.

The horizontal forces at the upper rim of the tote box are to be absorbed by vertical weld joints connecting the side walls to each other. This effect can additionally be increased by corner brackets glued on at the side. The long weld seams, however, make the manufacturing process very complex, and the provision of the additional corner brackets increases the complexity yet again.

The manufacturing process is very time-consuming and susceptible to errors. In particular, there is the risk that poor weld joints will occur and perpendicularity is not ensured. For large-volume orders, special profile lengths have to be produced, and warehousing requires much space.

EP 0 874 595 B1 describes a stackable transport container comprising a self-locking upper rim. The container is composed of a uniformly thick, foldable container blank, comprising a bottom, two upright end walls, two upright side walls, and four end flaps. The side walls and the end walls have downwardly folded tabs, over which an upper rim is placed, which automatically engages the tabs.

Horizontal forces are absorbed by the peripheral, single-piece top rim and by added corner reinforcements or insertable corner profiles. Separate rims thus have to be provided for each container size. Due to the large number of added corner pieces, production and assembly are very complex.

A tote box is known from DE 295 17 973 U1, in which the side walls are twin-wall sheets made of thermoplastic resin. The upper edges of the side walls are provided with a turnover rim, which is integrally formed on the side walls in one piece and formed by a rigid bent edge of the twin-wall sheet. This results in the formation of a peripheral cavity. The lower end of the turnover rim is separated from the side walls by an open joint. At the sides and corners, the side walls are held together positively by way of connecting pieces using rim, folding and side connectors. The described tote box has a complicated construction comprising a large number of protrusions, edges, and projections. The production of the same is very complex as a result of the large number of individual parts.

In U.S. Pat. No. 5,037,027 A, a folded base plate is shaped to obtain a container. U-shaped profiles are pushed over the upper rim. Corner pieces reside in the four corners, which are shaped so as to extend over the U-shaped profiles, where they are secured by way of pins. An upper rim is integrally formed on the corner pieces, which ensures that the container can be stacked. The pins also retain the side walls in the U-shaped profiles. The horizontal and vertical forces are absorbed by the corner pieces fastened to the peripheral profiles by way of pins, and furthermore by the angular profiles fastened additionally to the vertical corners. A very large number of individual parts is needed to achieve adequate stability. By virtue of the superimposed corner part, projections and protrusions are created, which may be disadvantageous.

U.S. Pat. No. 2,544,283 A describes a transport container made of a folded blank. It comprises a top rim having a lip on the underside, which engages in the side flaps of the erected container. The rim is composed of two regions, which are held by connecting clips.

Folded containers having a peripheral stacking rim at the top are also described in U.S. Pat. No. 2,941,710 A or NL 6 612 391 A.

SUMMARY OF THE INVENTION

It is the object of the invention to propose a transport and storage container that, on the one band, has a low weight and, on the other hand, still has high stability and as few protrusions and projections as possible. Moreover, it should be easy and cost-effective to produce with good quality. In particular, the process times for container fabrication are also to be minimized.

The transport and storage container of the invention is composed, when unassembled, of a single-piece foldable container blank. The container blank comprises a bottom, two side walls foldable about a folding line, two end walls foldable about a folding line, and four corner flaps foldable inwardly at the side walls or the end walls about a folding line. In the case of a rectangular transport and storage container, the side walls are always disposed on the longer sides. In the case of a square cross-section, it does not matter which is referred to as a side wall and which is referred to as an end wall. The four corner flaps can also be located at the end walls; however, keeping material optimization in mind, this may result in increased scrap.

The corner flaps are at a maximum sufficiently wide that, when the container is assembled, they fit beneath the lower edge of the attached stacking profiles.

Two mutually opposing corner flaps should in each case advantageously be sufficiently long that they, when folded over and upright, are equal to the entire side length that they cover. Accordingly, they should always be disposed on the longer wall. Since double the material thickness is then present on the end faces, it is advantageous if the potentially present handles are also provided on this side. In this way, high stability and high carrying capacity are achieved.

The folding lines are grooved, embossed, rolled or scored. Preferably a plotter is used, which generates the contours of the entire container blank.

During the production of the contours of the container blank, respective turnover rims are provided on the upper rim of the upwardly foldable side and end walls, each of the turnover rims being foldable outwardly about a score against the associated side wall and end wall.

The turnover rims can be folded both inwardly and outwardly. Inward folding, however, requires additional effort and entails drawbacks, since the container blank would first have to be rotated and scored on the back side.

In assembling the container, a stacking profile, which is open at the bottom, is placed around the upper turnover rim, which due to being folded over has double the wall thickness. The stacking profile has a U-shaped design. It comprises two legs, these being an inner leg and an outer leg, wherein a hook rim is integrally formed on the inside of the outer leg. The hook rim is provided at a height so as to extend beneath the lower rim of the turnover rim and become hooked therein. The hook rim can be designed so as to be upwardly slanted by an angle <90°. The stacking profile thus automatically snaps into place over the rim of the upright side and end walls and is securely locked.

According to the invention, a corner piece is provided for each of the four container corners in assembling the container. Each corner piece comprises a base body having an upper stacking rim. The base body fills a corner recess situated in the corners of the container. Two insertion profiles are integrally formed on the base body, each having an angled profile section at the front end. The angled profile section is designed so as to positively fit into a respective profile recess of the side walls and the end walls. The lengths of the stacking profiles are dimensioned such that they extend over the insertion profiles flush against the stacking rim.

The thickness of the insertion profiles corresponds to the wall thickness of the side and end walls. The thickness of the angled profile section corresponds to twice the wall thickness of the side and end walls.

As a result of the positive connections, the four corner pieces are fastened to each other by way of the clipped-on stacking profiles on the container walls under tensile- and compression load.

To ensure good stackability of multiple containers, the stacking profiles and the corner pieces comprise uniformly shaped stacking rims that extend around the entire periphery.

In a preferred embodiment, the stacking profiles are fastened to the insertion profiles by way of screw connections. These prevent the container parts from detaching under heavy mechanical action. Compared to rivet joints, which are likewise possible, screw connections have the advantage of being subsequently detachable.

So as to increase the stability of the peripheral stacking rim and absorb horizontal forces, a molding may be present at the stacking rim of the corner piece, which fits into a corresponding opening of the hollow stacking rim of the stacking profile so that the stacking profile is horizontally secured on the corner piece.

This is particularly advantageous when the container blank is constituted by plastic structured-core panels. Structured-core panels are composed of two outer walls disposed at a distance from each other, having interposed protuberances. When structured-core panels are used, the folding lines are provided on the wall side located on the inside of the container, thus creating a predetermined bending point. On the outside, the container is only bent over at the folding lines and thereby closed. This creates a closed container having no sharp edges.

With structured-core panels, the score on the turnover rims is formed by cutting open the interior panel wall, whereby the tabs can be bent easily around the side rim.

Depending on the desired load-bearing capacity, it is also possible for a transport and storage container to be made entirely, or at least partially, of corrugated cardboard or aluminum honeycomb panels.

The corner piece is preferably an injection-molded plastic part. Since the same corner pieces are always used, these can be produced very effectively in large quantities.

The stacking profile is preferably a continuously cast plastic part. Depending on the size of the transport and storage containers, the stacking profiles can be produced and cut to size cost-effectively in large quantities.

For a high load-bearing capacity, the corner flaps can be fastened to the end walls at least in a localized manner when the container is assembled. This is achieved by thermal welding, which may be done in a punctiform manner or extensively. Both surface areas are exposed to hot air until the surfaces thereof liquefy and fuse by way of joining. In this way, a permanent and sturdy connection is established. Another option is to adhesively bond the two parts in a punctiform or extensive manner.

The corner pieces and the stacking profiles are shaped so that they have the same peripheral outer shape, without there being any projections or protrusions.

A corner molding may be formed at the bottom of the base body of the corner piece so as to cover a design dependent gap. The gap, which is one wall thickness wide, is created in the corner regions by the inward folding of the corner flaps.

The transport and storage containers have a low weight, yet high stability and load-bearing capacity. The corner joints cannot detach even under massive impact against the sides, for example when another box is pushed on roughly. The space of the container blank is used very effectively. Utilization of the stacking profiles is done in a materialsaving manner, since a large number of short stacking profiles are used. The production time is considerably shorter, lowering direct manufacturing costs, investments for miter milling and sawing as well as for welding equipment, such as for corners or butt welds, are entirely eliminated. The profiles and injection-molded corners that are used can be standardized, preproduced and stored in large quantities in a cost-effective manner.

BRIEF DESCRIPTION OF THE DRAWINGS

The invention will be described in more detail hereafter based on one exemplary embodiment. In the drawings.

DETAILED DESCRIPTION OF THE INVENTION

The described exemplary embodiment is a preferred variant of a container for transporting and storing small parts for automobile production. The finished storage and transport container is to have a size of 800×800×250 (L×W×H in mm).

Figure 1:
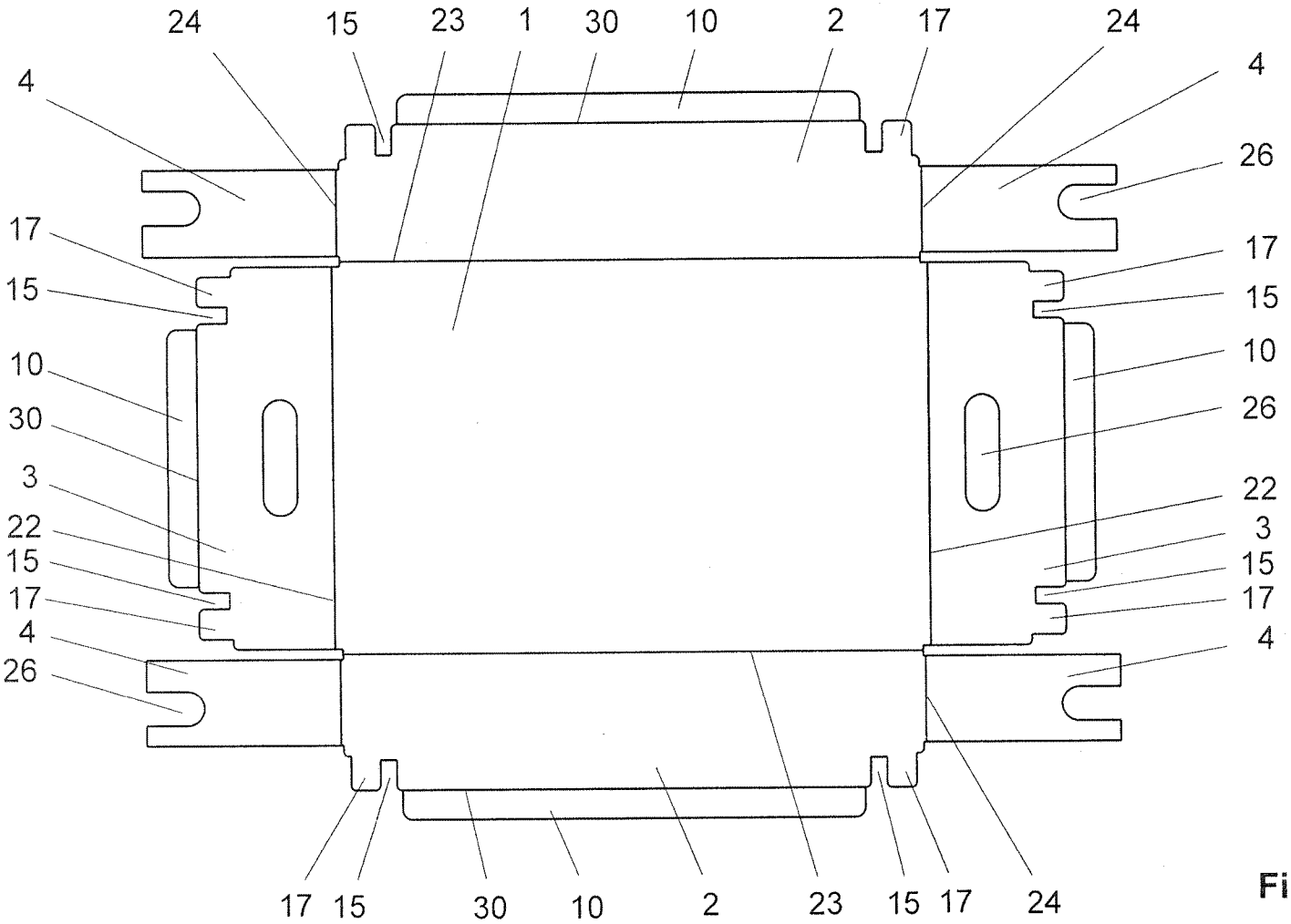
FIG. 1 shows a foldable container blank.

FIG. 1 shows a top view onto a foldable container blank, it is composed of a single-piece, 5 mm thick, plastic structured-core panel. A contour is generated by way of a plotter, so that a bottom 1, two side walls 2 foldable about a folding line 23, and two end walls 3 foldable about a folding line are created. Two corner flaps 4, which can each be folded inwardly about a folding line 24, are formed at each of the two side walls 2. It is important that all edges extend absolutely parallel to each other.

The corner flaps 4 are sufficiently long as to cover the width of the end wall 3 and to abut in the center of the end walls 3 when folded together. Handle cut-outs 28 for handles 28 that can be inserted at a later stage are provided on the corner flaps 4. Handle cut-outs 28 are also incorporated in the two end walls 3. The folding lines 22, 23 and 24 are likewise scored by way of the plotter.

Respective turnover rims 10 are integrally formed on the upper rim of the upwardly foldable side walls 2 and the upwardly foldable end walls 3, each of the turnover rims being foldable outwardly about a score 30 against the associated side wall 2 and end wall 3. The score is designed so as to completely sever the inner wall of the structured-core panel and for folding over to take place about the second wall, which is later the outer wall.

The turnover rims 10 do not extend over the entire width of the side and end walls, but only to just before a profile recess 15. This profile recess 15 is approximately as high as a turnover rim 10. A corner tab 17 is formed between the profile recess 15 and a corner recess 18.

Figure 2:
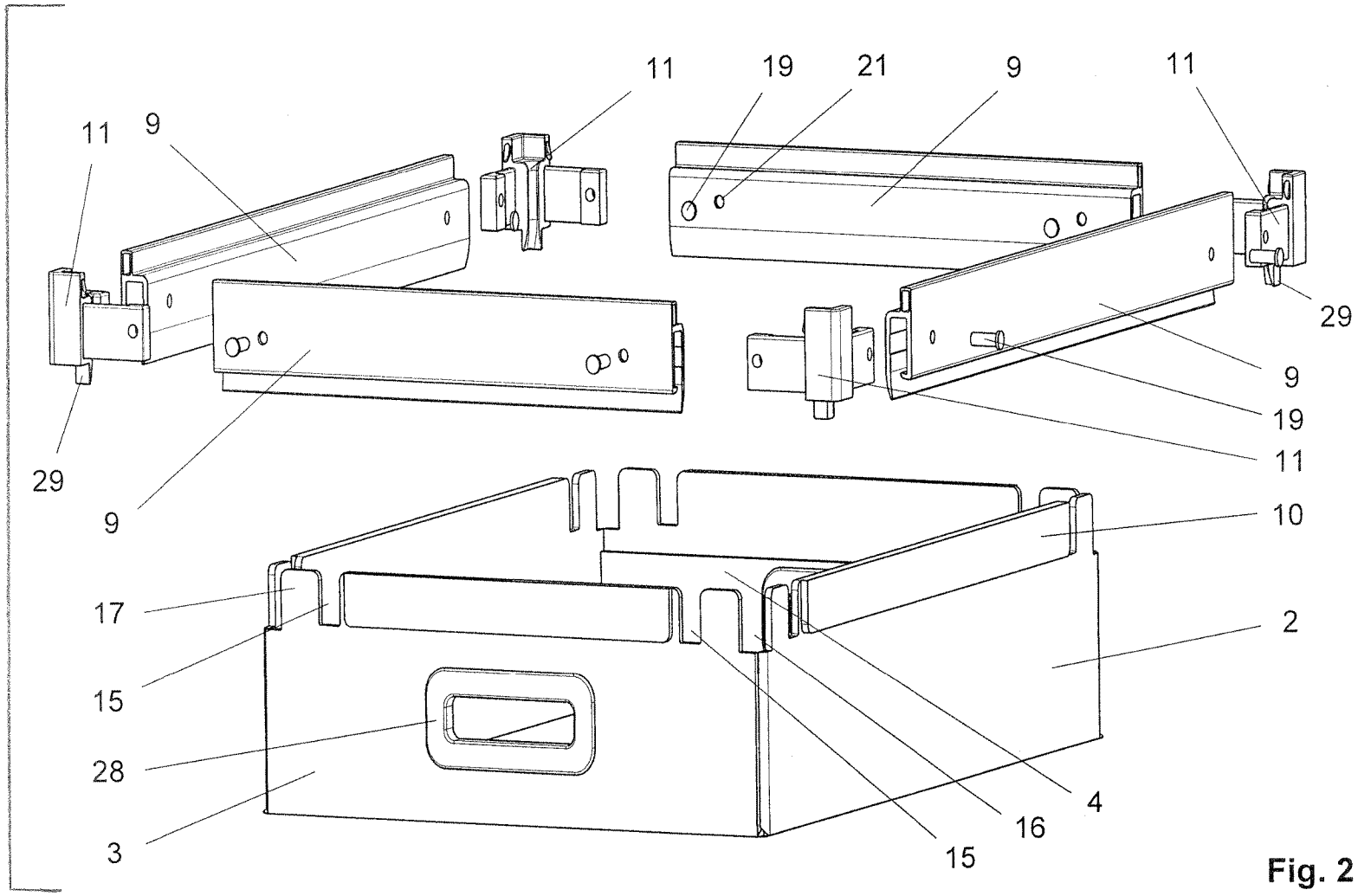
FIG. 2 is an exploded view of the storage and transport box.

FIG. 2 shows individual parts of a transport and storage container in an exploded view, comprising a container blank that is already folded, having folded-over turnover rims 10. Handles 28 are inserted into the two handle cut-outs 28 and the four handle cut-outs 26 in the corner flaps. The handles 28 have a two-piece design and include a peripheral groove, which corresponds to twice the thickness of the structured-core panels, and a snap-fit mechanism. The two handle halves are inserted into the handle cut-outs 28 and snapped together. The insertion of the handles causes the corner flaps 4 to be retained on the end walls 3, whereby additional locking is not needed.

Figure 5B:
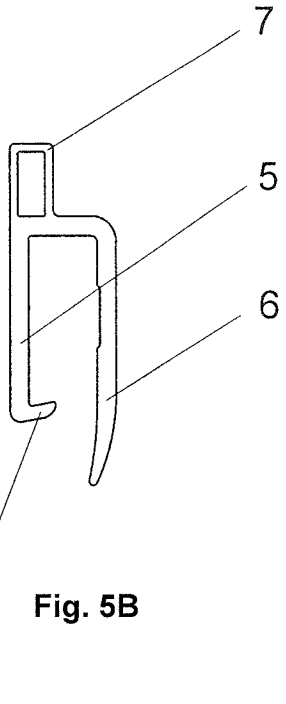
FIGS. 5A, 5B show the stacking profile in front view and end view, respectively.
Figure 5A:
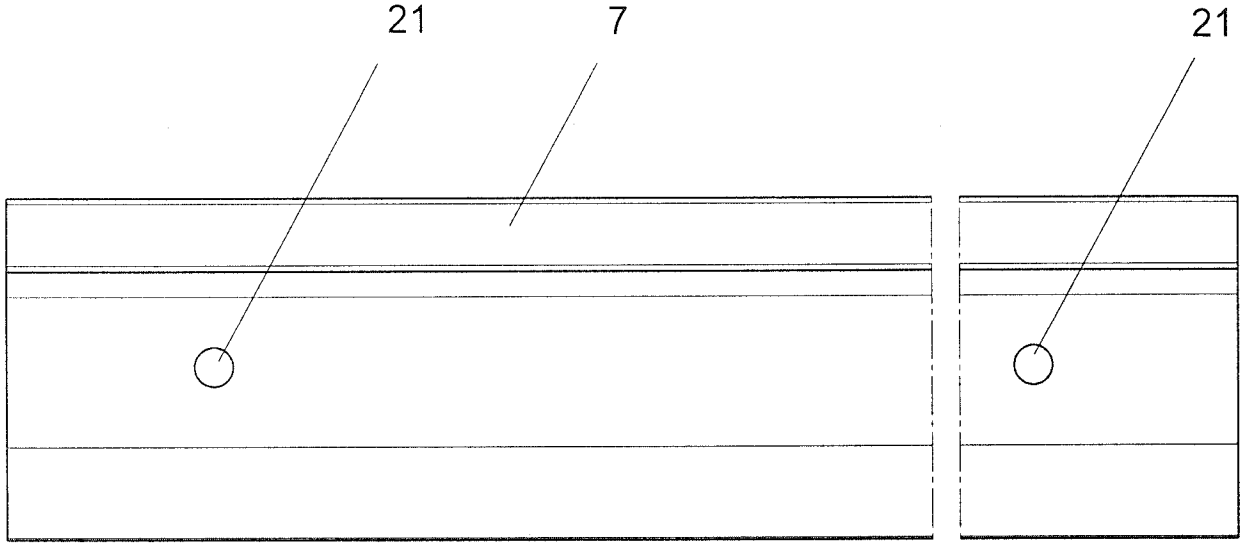

A stacking profile 9, which is open at the bottom, can be attached around the upper rim, which due the turnover rim 10 to being folded over has double the container wall thickness. FIGS. 5A, 5B show such a stacking profile 9 in front view and end view, respectively. The stacking profile 9 is a continuously cast plastic part and has a U shape. It comprises an inner leg 8, an outer leg 5 and a hook rim 8 that is integrally formed on the inside of the outer leg 5 and, in the attached state, can be latched over the end of the outwardly folded turnover rim 10 of the side walls 2 and of the end walls 3.

The hook rim 8 is designed so as to be upwardly slanted by an angle of approximately 80°. The inner leg 6 is bent slightly inward. This allows slight spreading when the stacking profile 9 is attached. Tension is also generated when the stacking profile 9 is attached, ensuring secure seating of the hook rim 8. The stacking profile 9 thus automatically snaps into place over the rim of the upright side walls 2 or end walls 3. The width of the turnover rims 10 corresponds to the inside width of the stacking profiles 9 from the upper stop of the same to the hook rim 8 of the same.

To ensure good stackability of multiple containers, the stacking profile 9 has a hollow stacking rim 7 at the top. A stacking rim 12 ends flush on the outer side and is wide enough on the inside that the next transport and storage container can be positively placed thereon.

Figures 3A, 3B, 3C, 3D, 3E:
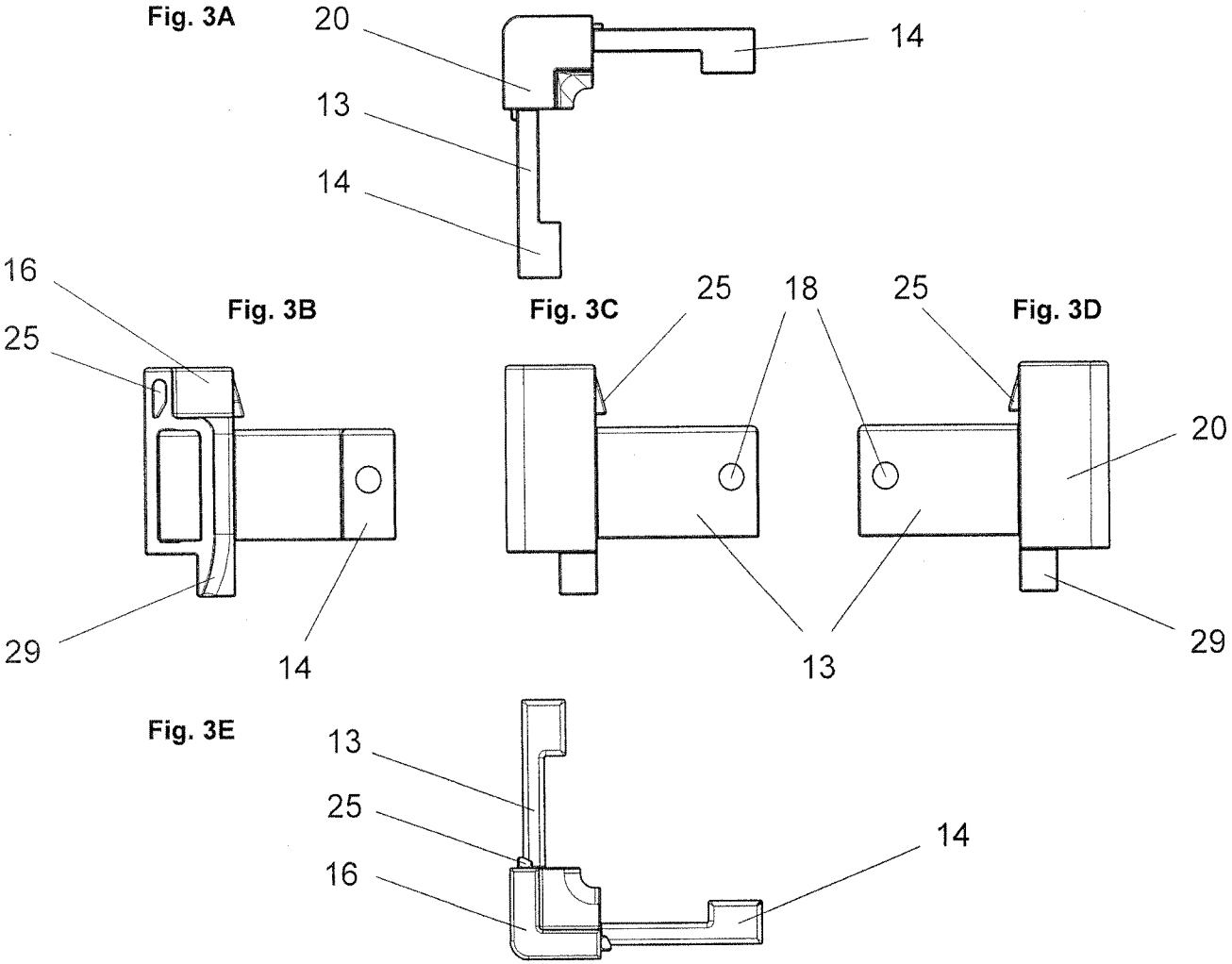
FIGS. 3A, 3B, 3C, 3D, 3E show the corner piece in five views.
Figure 4A:
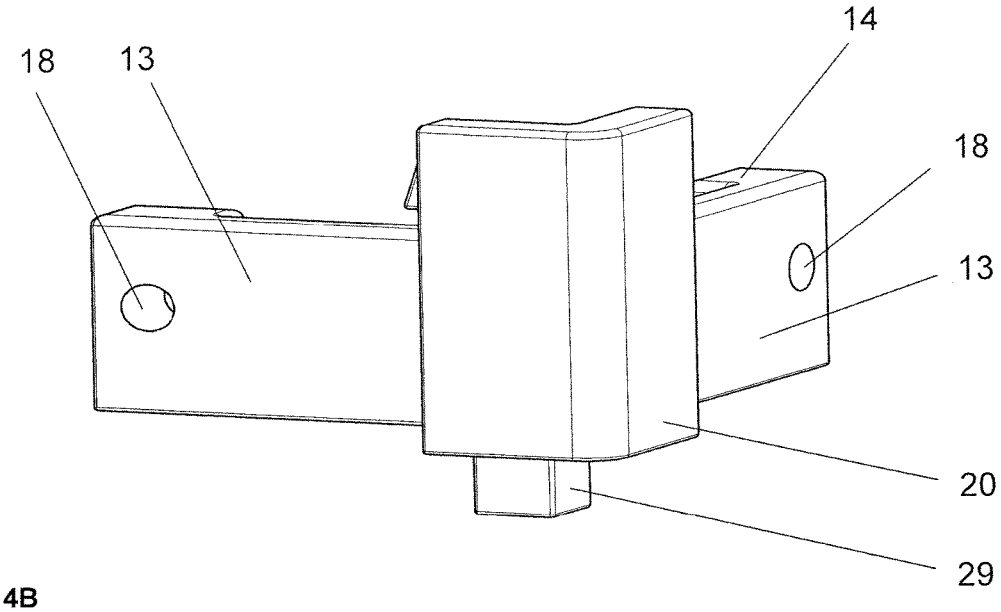
FIGS. 4A, 4B show the corner piece in two perspective views.
Figure 4B:
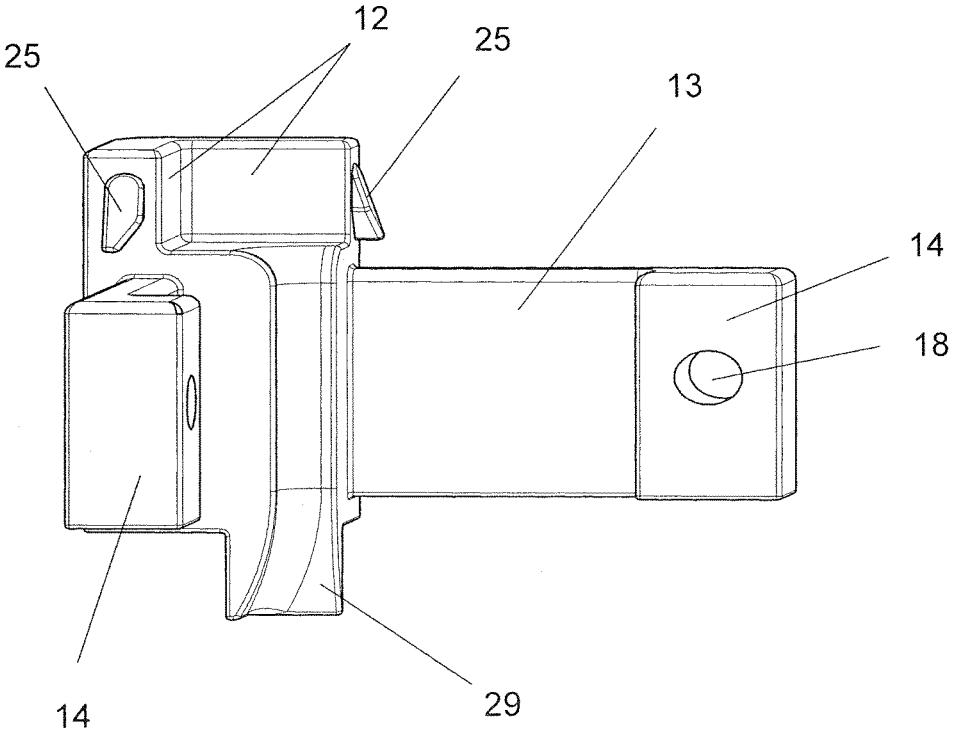

FIG. 2 shows how four corner pieces 11 can be fitted together with the stacking profiles 9. The corner pieces 11 produced as injection-molded plastic parts are shown in five views in FIGS. 3A, 3B, 3C, 3D, 3E, wherein FIG. 3A shows the bottom view, FIG. 3E shows the top view, and three side views are FIGS. 3B, 3C, 3D. FIGS. 4A, 4B show perspective illustrations of a corner piece 11, from the inside (FIG. 3B) and from the outside (FIG. 3A).

Figure 6A:
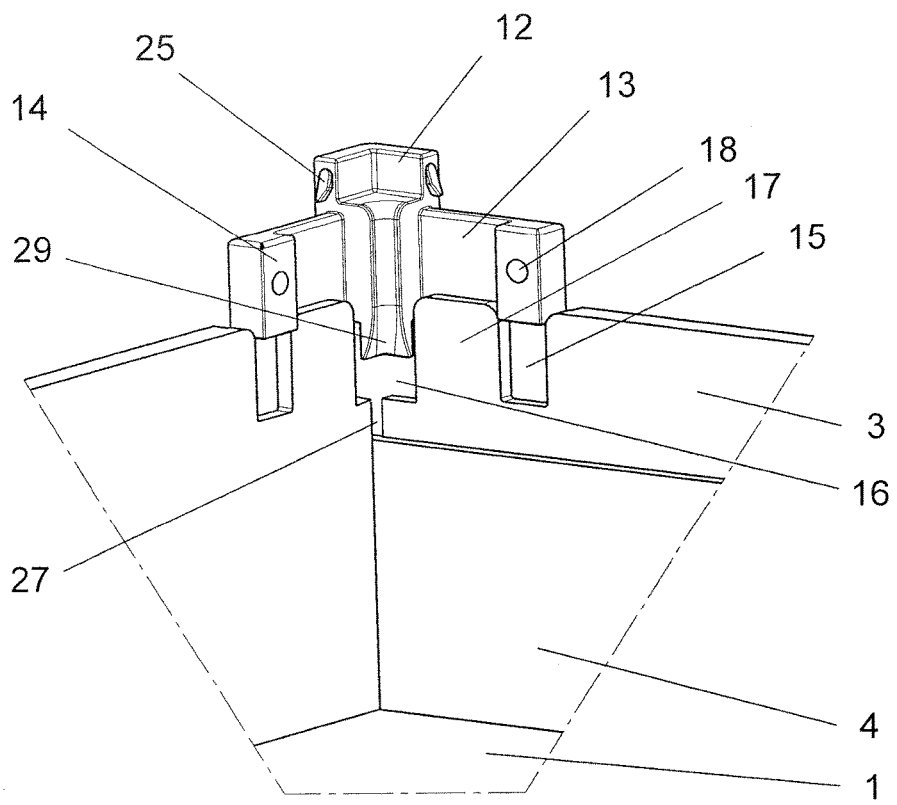
FIG. 6A shows the assembly steps of inserting a corner piece and FIG. 6B shows a further stage of assembly in which the corner piece has been fully inserted and a stacking profile has been attached over a turnover rim and connected to the corner piece.
Figure 6B:
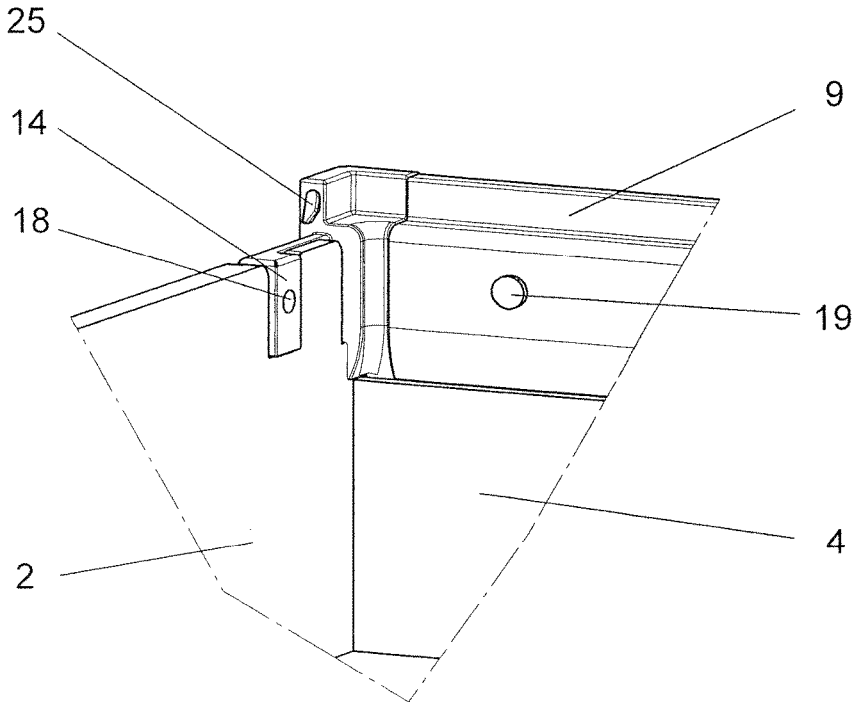

FIGS. 6A, 6B show how the corner pieces 11 can be mounted, wherein in FIG. 6B a corner piece 11 has been inserted and a stacking profile 9 has been attached.

Each of the four corner pieces 11 comprises a base body 20, on the top of which a stacking rim 12 is integrally formed. Two insertion profiles 13 are integrally formed on the base body so as to be perpendicular to each other, each having an angled profile section 14 at the front end.

The angled profile section 14 is as wide and as long as the profile recess 15, whereby it fits positively into a respective profile recess 15 in a side wall 2 and in an end wall 3, thereby bringing about a stable positive fit. The stacking profiles 9 extend laterally across the insertion profiles 13 against the stacking rim 12, so that no gap is formed.

To prevent the individual parts from being able to detach on their own under very high loads, the stacking profiles 9 are fastened to the insertion profiles 13 by way of screw connections. The stacking profiles 9 have boreholes 21 for this purpose, and the angled profile section 14 of the corner pieces 11 comprise boreholes 18, into which threaded sleeves are inserted from one side and screws are screwed in from the other side.

It is also possible that the boreholes 18, and thus the screw connections 19, are not located in the angled profile section 14, but in the 5 mm thick shaft of the insertion profile 13. This also provides fastening on the corner tab 17, and vertical forces can also be absorbed.

To connect the stacking rims 12 of the corner pieces 11 horizontally to the stacking rims 9, and thereby secure these, moldings 25 are molded onto the side of the stacking rims 12, which fit into the corresponding opening of the hollow stacking rim 7 of the stacking profile 9.

FIG. 6A shows that a design dependent gap 27 is created by folding the corner flap 4 over onto the end wall 3. This gap is closed by a corner molding 29.

Figure 7:
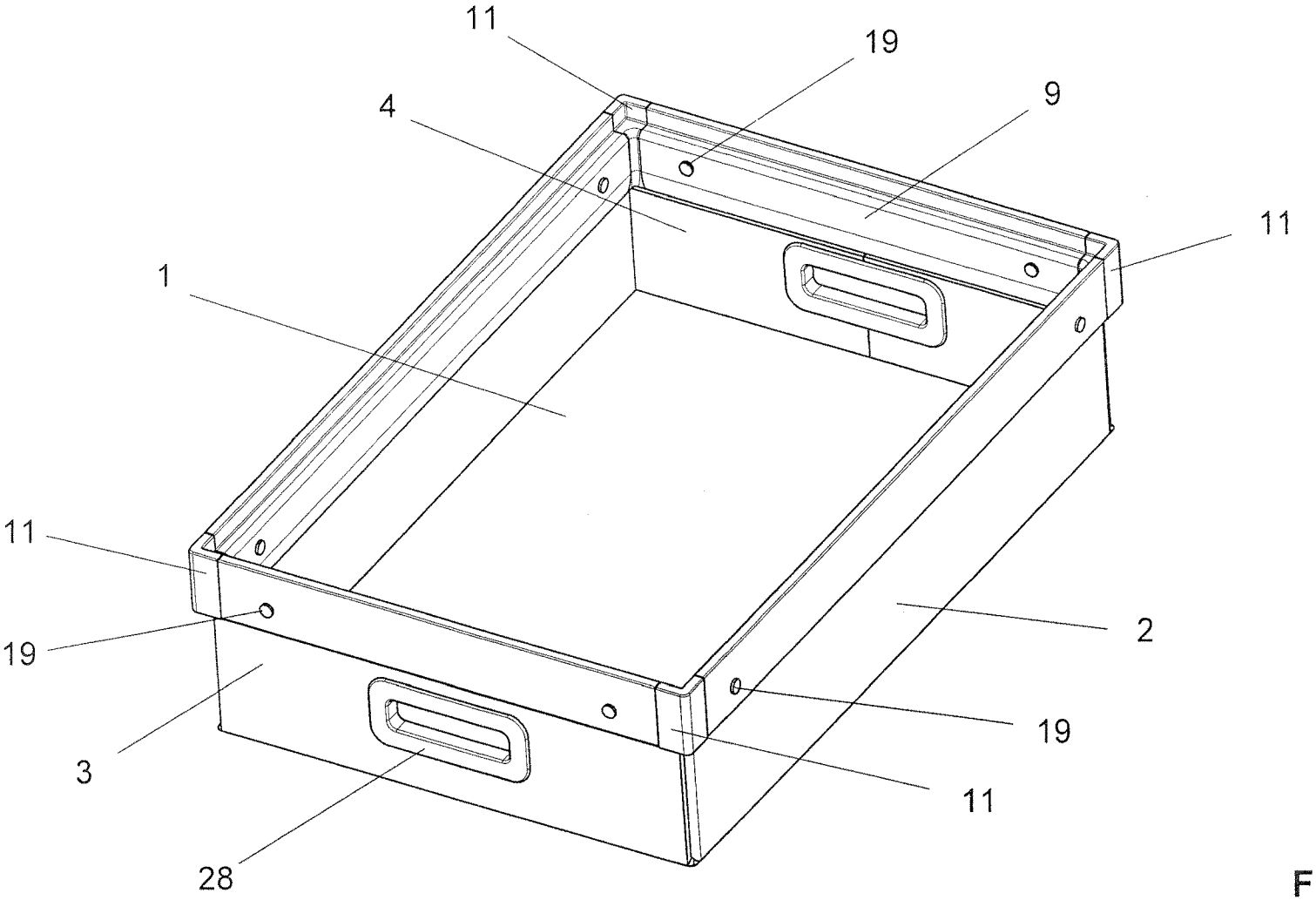
FIG. 7 shows the assembled transport and storage container.

FIG. 7 shows a fully assembled transport and storage container. Because it has few components, it is light, but on the other hand it is highly stable, it has few protrusions and projections. The container blank can be entirely plotted or stamped. In this way, it is possible to precisely adhere to the dimensional accuracy by being true to the contour, whereby low manufacturing tolerances are made possible.

The novel fastening of the corner pieces by way of the horizontally and vertically positively connected parts allows high load-bearing capacity to be achieved.

Because it has few parts, the transport and storage container is easy and cost-effective to produce, in particular since the is no need to purchase complex equipment for miter cuts, or welding technology for the corners and for butt welding. No additional material is needed for fastening rims.

The process times for box fabrication are shortened considerably. Poor weld joints at the critical corners are avoided. Moreover, the profile rods can be utilized considerably better since four relatively short portions must be cut to size for the sides. Due to the simple, more lightweight and more cost-effective injection-molded corner pieces, this type of container can be assembled essentially on-site at the customer's facility with the simplest of assembly means. End users can be supplied with the stamped container blanks by a central fabrication facility and are only required to cut the stacking profiles 9 to length and mount, and optionally screw, these together with the corner pieces 11.

The invention claimed is:

1. An unassembled transport and storage container which is stackable when assembled, comprising:

a foldable container blank having a bottom, two side walls each foldable about a respective first folding line, two end walls each foldable about a respective second folding line, the side walls and the end walls being of a predetermined same thickness, four corner flaps each foldable inwardly at a respective one of the side walls or the end walls about a respective third folding line, a respective turnover rim at a top edge of each of the side walls and end walls, on each of the side walls and end walls a respective score parallel to the top edge of the side wall or the end wall, and each of the turnover rims being configured to be folded outwardly about a respective one of the scores and against the respective side wall or end wall at the top edge of which the turnover rim is located to form a rim thickness twice the predetermined same thickness of the side walls and the end walls;

stacking profiles each configured to be attached over a respective one of the turnover rims of the side walls and the end walls and comprising in transverse cross-section, an inner leg and an outer leg, the inner and outer legs connected by connecting structure only at their proximal ends and otherwise spaced from each other to define a space configured to receive a respective one of said turnover rims when said turnover rim has been outwardly folded and a hook rim integrally formed on an inner side of the outer leg and configured to be latched over a longitudinal edge of a respective one of the outwardly folded turnover rims, and an stacking rim integrally formed on and surmounting the stacking profile connecting structure;

further comprising corner pieces configured to be received between ends of adjacent pairs of the stacking profiles, wherein each corner piece comprises a base body having a stacking rim surmounting the base body and configured to align with the stacking rims of the stacking profiles;

two insertion profiles are integrally formed on the base body perpendicular to each other and each of the insertion profiles has an angled profile section at a distal end thereof, thickness of each of the insertion profiles, in a direction perpendicular to the plane of the respective side wall or end wall, other than at the angled profile section thereof being same as the wall thickness;

a respective profile recess is formed in each of the side walls and end walls, each of the angled profile sections is of such width and length in a plane parallel to a plane of the respective side wall or end wall in which the respective profile recess is formed so that each of the respective angled profile sections forms a positive fit with the respective profile recess of the respective one the side walls and the end walls and each of the angled sections is of a thickness, in a direction perpendicular to the plane of the respective side wall or end wall, which is twice the wall thickness; and the stacking profiles are configured to extend over the insertion profiles flush against the stacking rims of the corner pieces.

2. The unassembled transport and storage container according to claim 1, further comprising screw connections configured to connect the stacking profiles to the insertion profiles.

3. The unassembled transport and storage container according to claim 1, further comprising a respective molded body formed on each of two end faces of the stacking rim of each of the base bodies, wherein the end faces are at a right angle relative to each other, and corresponding openings in the stacking rims of the stacking profiles, each of the openings configured to engage a respective one of the molded bodies and thereby secure the stacking profiles to the corner pieces.

4. The unassembled transport and storage container according to claim 1, wherein the container blank is comprised of plastic structured-core panels.

5. The unassembled transport and storage container according to claim 1, wherein each of the corner pieces is an injection-molded plastic part.

6. The unassembled transport and storage container according to claim 1, wherein the stacking profile is a continuously cast plastic part.

7. The unassembled transport and storage container according to claim 1, wherein the corner flaps are configured to be fastened to the end walls when the container is assembled.

8. The unassembled transport and storage container according to claim 1, wherein each of the corner pieces and stacking profiles has the same peripheral outer shape.

9. The unassembled transport and storage container according to claim 1, wherein a downward extension is formed at a corner of the base body of each of the corner pieces and is configured so as to cover a gap.

10. A transport and storage container produced by assembling the unassembled transport and storage container of claim 1.

11. The unassembled transport and storage container according to claim 1, wherein said width and length of the angled profile is same as a width and length of the profile recess.

* * * * *